US007703154B2

(12) United States Patent
Botello

(10) Patent No.: US 7,703,154 B2
(45) Date of Patent: Apr. 27, 2010

(54) SAFETY LID

(75) Inventor: Michael Bryan Botello, 1846 Hollister #6, Houston, TX (US) 77080

(73) Assignee: Michael Bryan Botello, Houston, TX (US)

( * ) Notice: Subject to any disclaimer, the term of this patent is extended or adjusted under 35 U.S.C. 154(b) by 1041 days.

(21) Appl. No.: 11/220,808

(22) Filed: Sep. 7, 2005

(65) Prior Publication Data

US 2007/0050899 A1 Mar. 8, 2007

(51) Int. Cl.
*A47K 13/00* (2006.01)

(52) U.S. Cl. ..... 4/253; 4/246.1

(58) Field of Classification Search ..... 4/253, 4/246.1, 661; 220/4.01
See application file for complete search history.

(56) References Cited

U.S. PATENT DOCUMENTS 2,157,693 A * 5/1939 Ernolf ..... 4/253
3,116,527 A 1/1964 Springer
3,431,004 A 3/1969 Schell
3,477,070 A 11/1969 Kimber
3,920,273 A 11/1975 Scholtze
4,145,771 A * 3/1979 Khazin ..... 4/253
4,296,504 A 10/1981 Lawson
4,395,784 A 8/1983 Foster
4,404,695 A 9/1983 Camp
4,502,167 A 3/1985 Porzelius
4,894,870 A 1/1990 Buckshaw et al.
5,003,641 A 4/1991 Selman, Jr.
5,347,663 A 9/1994 Yost
5,669,081 A 9/1997 Scherer
5,682,776 A 11/1997 Burt
5,937,449 A 8/1999 Rey
6,108,827 A 8/2000 Espadas
6,173,454 B1 1/2001 Alvarez
6,314,589 B1 11/2001 Schilt

FOREIGN PATENT DOCUMENTS

CH 663144 A5 11/1987

OTHER PUBLICATIONS

PCT/US2006/007483 International Search Report, Jul. 27, 2007.

* cited by examiner

*Primary Examiner*—Tuan N Nguyen
(74) *Attorney, Agent, or Firm*—Conley Rose, P.C.

(57) ABSTRACT

An embodiment of the safety lid system includes a container having an interior chamber and a lid moveably connected to the container, an arm having a locking end is functionally connected to the lid, and a holding device having an interior channel adapted for disposing a portion of the locking end is connected to the container. The locking end of the arm is moveable from a locked position wherein the locking end is disposed within the channel of the holding device securing the lid to the container in a position restricting access to the interior chamber and an unlocked position wherein the locking end is removed from the channel. The arm may be biased toward the container wherein when the system is in the locked position the arm must be urged outward from the container to lift the lid from the container.

15 Claims, 2 Drawing Sheets

SAFETY LID

FIELD OF THE INVENTION

The present invention relates in general to safety devices and more particularly to a device and method for restricting access into a toilet bowl.

BACKGROUND

Toilet lids are readily opened, providing easy access into the toilet bowl chamber. It is well known that toilet bowls are an attractive hazard to small children. Children often find the toilet bowl a prime location to float their boat and to deposit items. These make shift ponds pose a risk of infection, poisoning and drowning. Additionally, the deposited items tend to impair the efficient operation of the toilet bowl. Unrestricted access to toilet bowls poses similar risks to pets. Therefore, it is often desired to restrict access to toilet bowl chambers.

Heretofore, many devices have been provided in an attempt to restrict access to toilet bowls. These devices have failed to gain acceptance and wide spread use for various reasons including expense, difficult installation, difficulty in using, unsightly appearance and ineffectiveness.

Therefore, it is a desire to provide a safety lid system for restricting access to a chamber that addresses shortcomings of prior art lid systems. It is a further desire to provide a safety lid system that restricts access by children and pets to the toilet bowl. It is a still further desire to provide a safety lid kit that is readily connectable to existing toilet bowl installations.

SUMMARY OF THE INVENTION

In view of the foregoing and other considerations, the present invention relates to a safety lid system for restricting access to a chamber of a container and more specifically to restricting access by children and pets to a toilet bowl chamber.

Accordingly, a safety lid system is provided. In one embodiment of the present invention the safety lid system includes a container having an interior chamber and a lid moveably connected to the container, an arm having a locking end is functionally connected to the lid, and a holding device having an interior channel adapted for disposing a portion of the locking end is connected to the container. The locking end of the arm is moveable from a locked position wherein the locking end is disposed within the channel of the holding device securing the lid to the container in a position restricting access to the interior chamber and an unlocked position wherein of portion of the locking end is removed from the channel. It may be further desired to bias the locking end of the arm toward the container wherein when the system is in the locked position the arm must be urged outward from the container to lift the lid from the container. It may further be desired to adapt the locking end and the holding device such that to unlock the system the arm must be pulled away from the bowl, rotated, and then pulled out of engagement with the holding device.

In another embodiment of the present invention the safety lid system kit is provided for restricting access to an existing toilet bowl system. The safety lid system kit includes an arm including a shaft section, a grip section, and a locking section having a ball end, the shaft slidably and rotatably connectable to the lid, a biasing mechanism connected to the arm biasing the ball end toward the toilet bowl when the arm is connected to the lid, a holding device forming a channel adapted for disposing the ball end, the holding device having a back wall connectable to the toilet bowl and an opposing front wall and a keyway formed through the front wall of the holding device extending along the length of the channel, the keyway having an entry end and a terminal end, the entry end having diameter greater than the diameter of the ball end and the remainder of the keyway having a diameter less than the diameter of the ball end and greater than the diameter of the locking section of the arm. It may further be desired to provide a detent or pocket proximate the terminal end of the keyway in chamber such that the biasing mechanism biases the ball end into the detent. For a more aesthetically pleasing and simpler installation the arm may be incorporated in a lid that is connectable to the toilet bowl. This lid may further include a slot for disposing the arm when the system is unlocked.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
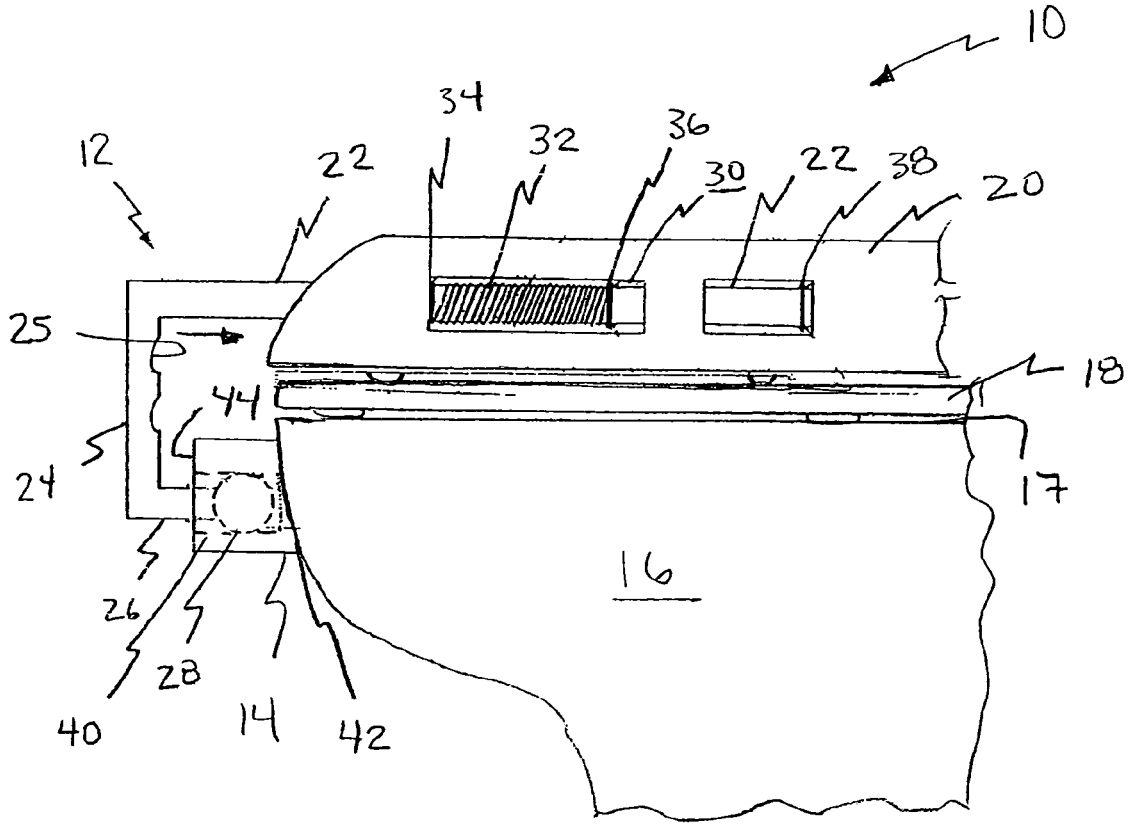
FIG. 1 is a side view of an embodiment of safety lid of the present invention illustrated in the locked position.

Refer now to the drawings wherein depicted elements are not necessarily shown to scale and wherein like or similar elements are designated by the same reference numeral through the several views.

Figure 2:
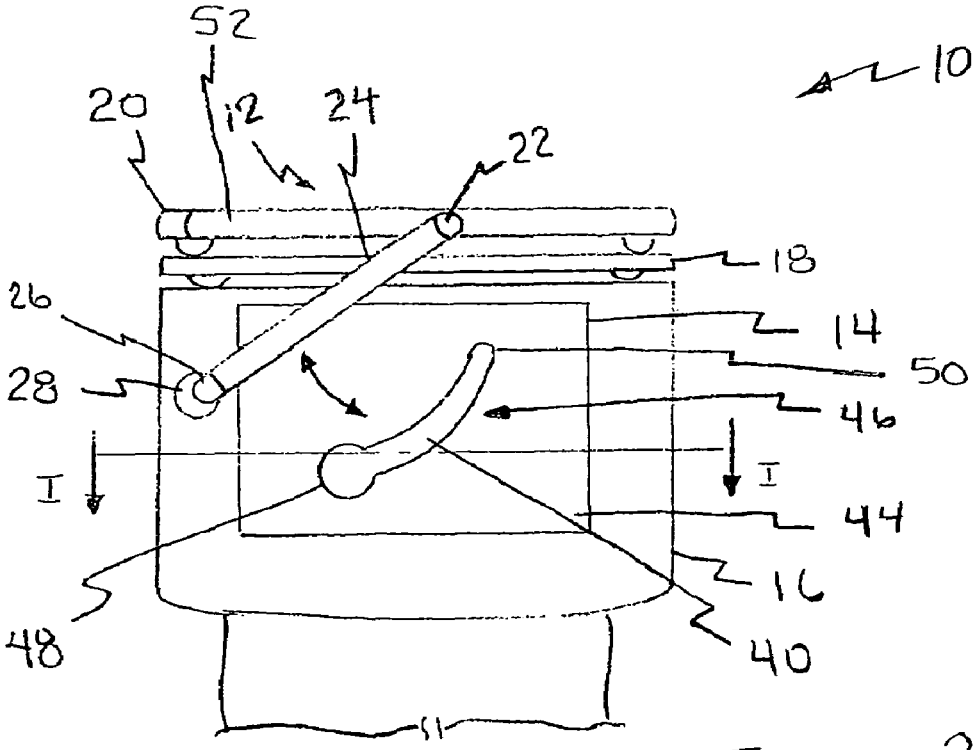
FIG. 2 is a front view of an embodiment of the safety lid system of the present invention illustrated in the unlocked position.
Figure 3:
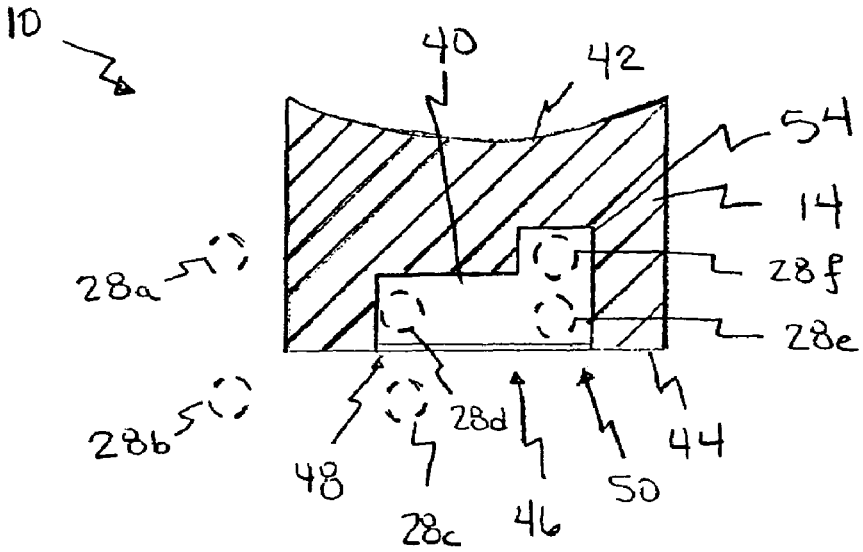
FIG. 3 is a cross-sectional view of the holding device along the line I-I of FIG. 2 with the positions of the ball end during operation of the safety lid system superimposed.

FIG. 1 is a side view of an embodiment of a safety lid system of the present invention, generally denoted by the numeral 10. Safety lid system 10 includes a biased arm 12 selectively engageable with a holding device 14. The embodiment illustrated in FIGS. 1 through 3 are exemplary of a safety lid system 10 for use with a common toilet to restrict access by small children. A common toilet includes a bowl 16 having an interior chamber 17, a seat 18, and a lid 20. Lid 20 is hingedly positioned so as to be moveable between a closed position (shown) blocking access to interior chamber 17 and an open position providing access to interior chamber 17.

Biased arm 12 is functionally connected to lid 20. Biased arm 12 includes a substantially U-shaped member having a shaft 22, grip 24, and a locking section 26 having a ball end 28. Grip portion 24 may include grooves 25 adapted for fitting the fingers of a user. Biased arm 12 is functionally connected to lid 20 in a manner such that arm 12 is at least partially rotatable and slidably connected to lid 20. Biased arm 12 in the illustrated embodiments is biased toward lid 20 as illustrated by the arrow.

In the embodiment illustrated in the various Figures, biased arm 12 is incorporated in lid 20, wherein a safety lid kit may include a lid 20 having a biased arm connectable to bowl 16 and a holding device 14 connectable bowl 16. However, it should be recognized that biased arm 12 may be functionally connected to lid 20 in other manners such as, but not limited to, brackets and/or a housing assembly mounted on lid 20. In this alternative embodiment a safety lid system 10 kit may include biased arm 12 and holding device 14 for connection to an exiting toilet bowl 16 and lid 20. Specific mechanism and/or assemblies for functionally connecting biased arm to lid 20 are not shown, as the various mechanism and assemblies for accomplishing the functional connection are well known in the art.

Lid 12 forms a cavity 30 in which a portion of shaft 22 is disposed. A biasing mechanism 32, such as, but not limited to, a spring is operationally connected to shaft 22. In the illustrated embodiment a spring 32 is disposed about shaft 22 proximate a first wall 34 of cavity 30. Fixed end 36 of spring 32 is anchored in a position relative to shaft 22 such that spring 32 urges fixed end 36 away from first wall 34 thereby biasing grip 24 and ball end 28 toward bowl 16. Fixed end 36 may be positioned relative to shaft 22 via any suitable connection including, but not limited to, welding, crimping, a tab or other projection extending from shaft 22. An element 35, such as a washer, may provided between first wall 34 and biasing mechanism 32 to maintain biasing mechanism 32 in cavity 30. A stop 38 may be spaced from fixed end 36 of spring 32 and connected to shaft 22 to limit the travel of biased arm 12.

Holding device 14 is a substantially box shaped housing having an internal channel 40, illustrated by hidden lines, adapted for selectively engaging and holding biased arm 12. A back wall 42 of holding device 14 is connected to bowl 16 substantially vertically below shaft 22 of biased arm 12. Holding device 14 may be connected to bowl 16 by any suitable mechanism including, but not limited to, adhesives, corresponding connectors or other means of connections that provide secure connection of holding device 14 in position for operation of the present invention. The connection of holding device 14 to bowl 16 may be temporary or substantially permanent. Holding device 14 includes a front wall 44 opposite back wall 42 providing access to channel 40. In the locked position, as shown in FIG. 1, ball end 28 is entrapped in channel 40 maintaining lid 20 in a position blocking access to chamber 17.

FIG. 2 is a front view of an embodiment of safety lid system 10 of the present invention shown in the unlocked position. In the unlocked position, biased arm 12 is disengaged from holding device 14 permitting lid 20 to be moved relative to bowl 16.

Front wall 44 of holding device 14 forms a keyway 46 providing access to channel 40. Keyway 46 extends substantially along the length of channel 40 between an entry end 48 and a terminal end 50. Entry end 48 has a diameter greater than the diameter of ball end 28 of biased arm 12 permitting the insertion of ball end 28 into channel 40. The width along the length of keyway 46 past entry end 48 to terminal end 50 is less than the diameter of ball end 28 and greater than the diameter of locking section 26 of biased arm 12.

As described in relation to FIG. 1, biased arm 12 is rotatably connected to lid 20 such that locking section 26 and ball end 28 may be rotated, at least partially, about the longitudinal axis of shaft 22. Keyway 46 is arcuate and shaped to match the arc of travel of ball end 28 having a radius equal to the length of grip section 24 of biased arm 12.

FIG. 3 is a cross-sectional view of holding device 14 along the line I-I of FIG. 2 with the positions of ball end 28 during operation of the safety lid system superimposed. When ball end 28 is at position 28*a* it is disengaged from holding device (housing) 14, and system 10 is in the unlocked position. When ball end 28 is at position 28*f* it is engaged by housing 14 and is in the safety locked position. Positions 28*b* through 28*d* illustrate the movement of ball end 28 from the static unlocked position 28*a* to safety locked position 28*f*.

Operation of safety lid system 10 is described with reference to FIGS. 1 through 3. In the static unlocked position 28*a*, ball end 28 is positioned outside of channel 40 and thus disengaged from housing 14 permitting movement of lid 20 relative to bowl 16. Biasing mechanism 32 is urging ball end 28 toward bowl 16. It may be desired that static unlocked position be located proximate to housing 14 and spaced outward from bowl 16. This may be accomplished by limiting the travel of shaft 22 relative to lid 20 through selection of biasing mechanism 32 and/or the positioning of stop 38. It may further be desired for static unlocked position 28*a* to comprise positioning biased arm 12 proximate to and aligned with the plane of lid 20. In this position 28*a*, grip 24 and locking section 26 may substantially follow the curvature of lid 20. Lid 20 may further include a slot 52 (FIG. 1) formed along its edge for substantially disposing biased arm 12 therein. Slot 52 may be adapted to substantially dispose locking section 26 and grip section 24. Desirably at least a portion of grip 24 extends from slot 52 exterior of lid 20 to allow a user to grasp grip portion 24.

To secure lid 20 to bowl 16 and restrict access to chamber 17 a user grasps biased arm 12 and pulls it outward from bowl 16 to position 28*b*, wherein ball end 28 extends past front wall 44 of housing 14. Grip portion 24 may include gripping grooves 25 to aide a user in grasping biased arm 12. The user then rotates biased arm 12 to position 28*c* wherein ball 28 is aligned with entry end 48 of keyway 46. The user then releases tension on biased arm 12 and biasing mechanism 32 urges ball end 28 through entry 48 into channel 40 shown as position 28*d*. The user then rotates biased arm 12 toward terminal end 50. Note that ball end 28 is entrapped within housing 14 as it is moved from entry 48 to terminal end 50 due to ball end 28 having a larger diameter than keyway 46. Once ball end 28 is rotated to terminal end 50 of keyway 46, shown as position 28*e*, the user can release biased arm 12. Biasing mechanism 32 then urges ball end 28 toward bowl 16 disposing ball end 28 within detent section 54 of channel 40. Position 28*f* is referred to herein as the safety locked position.

The safety locked position 28*f* provides a means for limiting or deterring access to the bowl chamber 17 in several manners. First, biasing mechanism 32 may provide a force sufficient to prevent the typical child of a desired age range from being able to remove ball 28 from either detent 54 or from housing 14 through entry 48. Further, safety lid system 10 requires that the user both pull and rotate biased arm 12 to move ball end 28 from the safety locked position. The combination of required pulling forces and movements required to unlock lid 20 eliminates access to the majority of children within a desired age range.

The steps of moving safety lid system 10 from the safety locked position 28*f* to the unlocked position 28*a* is briefly described. A user grips biased arm 12 and pulls it away from bowl 16, moving ball end 28 out of detent 54. The user then rotates ball end 28 through channel 40 to entry end 48. The user then pulls ball end 28 out of channel 40 through entry 48 and rotates ball end 28 out of alignment with entry 48. The user may then position and release biased arm 12 permitting access to bowl chamber 17.

From the foregoing detailed description of specific embodiments of the invention, it should be apparent that a system for restricting access to a toilet bowl that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A safety lid system comprising:

a container having an interior chamber;

a lid moveably connected to the container, the lid having a cavity formed therein;

an arm comprising:

a shaft with a first portion inserted into the cavity, a second portion extending parallel to the first portion, and a third portion extending normally therebetween, wherein each of the first portion and the second portion extends between a free end and an end connected to the third portion;

a stop coupled to the free end of the first portion; and a locking end disposed at the free end of the second portion, the locking end having a width;

a biasing member concentrically disposed about the first portion, the biasing member having a first end that is movable relative to the first portion and a second end that is immovable relative to the first portion and disposed between the first end of the spring and the stop; and a holding device connected to the container, the holding device having:

a back wall connected to the container;

a front wall opposing the back wall;

an interior channel adapted for receiving the locking end, the interior channel comprising:

a inlet section extending normally from the front wall;

an intermediate section connected to the first section and extending parallel to the front wall;

a detent section connected to the intermediate section and extending normally therefrom; and a keyway extending along the inlet and intermediate sections of the interior channel, the keyway having an entry end, a terminal end, and an intermediate portion extending therebetween, wherein the entry end has a width greater than the width of the locking end, and the intermediate portion and the terminal end each have a width less than the width of the locking end;

wherein the locking end is moveable from a locked position, wherein the locking end is disposed within the channel of the holding device securing the lid to the container in a position restricting access to the interior chamber, and an unlocked position, wherein the locking end is removed from the channel.

2. The system of claim 1, wherein the arm is slideably connected to the lid.

3. The system of claim 1, wherein the arm is rotatably connected to the lid.

4. The system of claim 1, wherein the lid further includes a slot adapted to substantially dispose the arm when the arm is in the unlocked position.

5. The system of claim 1, wherein the biasing mechanism urges the locking end of the arm toward the container.

6. The system of claim 5, wherein the biasing mechanism comprises a spring.

7. The system of claim 1, wherein the keyway is formed through the front wall of the holding device.

8. A safety lid system kit for restricting access to an open chamber of a toilet bowl, the system kit comprising:

a lid hingedly connectable to the toilet bowl and having a cavity, wherein, when the lid is connected to the toilet bowl, the lid is moveable between a closed position substantially covering the open chamber and an open position uncovering the open chamber;

an arm comprising:

a shaft with a first portion inserted into the cavity, a second portion extending parallel to the first portion, and a third portion extending normally therebetween, wherein each of the first portion and the second portion extends between a free end and an end connected to the third portion;

a stop coupled to the free end of the first portion;

a ball end disposed at the free end of the second portion, the ball end having a width; and a grip section disposed on the third portion;

a biasing member concentrically disposed about the first portion and urging the ball end toward the toilet bowl, the biasing member having a first end that is movable relative to the first portion and a second end that is immovable relative to the first portion and disposed between the first end and the stop;

a holding device having a channel adapted for receiving the ball end, the holding device having a back wall connectable to the toilet bowl and an opposing front wall; and a keyway formed through the front wall of the holding device extending along the length of the channel, the keyway having an entry end and a terminal end, the entry end having diameter greater than the diameter of the ball end and the remainder of the keyway having a diameter less than the diameter of the ball end and greater than the diameter of the second portion of the arm.

9. The system kit of claim 8, further including:

a detent adapted for disposing the ball end, the detent formed along the channel proximate the terminal end of the keyway and oriented toward the toilet bowl and away from the front wall of the holding device.

10. The system kit of claim 8, wherein the lid further includes a slot adapted to substantially dispose the arm when the arm is in the unlocked position.

11. The system kit of claim 9, wherein the lid further includes a slot adapted to substantially dispose the arm when the arm is in the unlocked position.

12. The system kit of claim 8, wherein the channel forms an arcurate path.

13. A safety lid system kit for restricting access to an open chamber of a toilet bowl having a lid connected to the toilet bowl for selectively covering the open chamber, the system kit comprising:

an arm including a shaft section, a grip section, and a locking section having a ball end, the shaft slidably and rotatably connectable to the lid;

a biasing mechanism concentrically disposed about the shaft section and connected to the shaft section, the biasing member biasing the ball end toward the toilet bowl when the arm is connected to the lid;

a holding device forming a channel adapted for receiving the ball end, the holding device having a back wall connectable to the toilet bowl and an opposing front wall; and a keyway formed through the front wall of the holding device extending along the length of the channel, the keyway having an entry end and a terminal end, the entry end having diameter greater than the diameter of the ball end and the remainder of the keyway having a diameter less than the diameter of the ball end and greater than the diameter of the locking section of the arm.

14. The system kit of claim 13, further including:

a detent adapted for disposing the ball end, the detent formed along the channel proximate the terminal end of the keyway and oriented toward the toilet bowl and away from the front wall of the holding device.

15. The system kit of claim 13, wherein the channel forms an arcurate path.

* * * * *